US008115696B2

(12) United States Patent
Skalina et al.

(10) Patent No.: US 8,115,696 B2
(45) Date of Patent: Feb. 14, 2012

(54) PHASED-ARRAY ANTENNA PANEL FOR A SUPER ECONOMICAL BROADCAST SYSTEM

(75) Inventors: Andre Skalina, Portland, ME (US); Torbjorn Johnson, Vaxholm (SE); Charles Michael Davison, Jr., Raymond, ME (US); John Schadler, Raymond, ME (US); Gary Lytle, Portland, ME (US)

(73) Assignees: SPX Corporation, Charlotte, NC (US); Radio Innovation Sweden AB, Kista (SE)

( * ) Notice: Subject to any disclaimer, the term of this patent is extended or adjusted under 35 U.S.C. 154(b) by 471 days.

(21) Appl. No.: 12/430,823

(22) Filed: Apr. 27, 2009

(65) Prior Publication Data

US 2010/0134374 A1 Jun. 3, 2010

Related U.S. Application Data

(60) Provisional application No. 61/047,772, filed on Apr. 25, 2008.

(51) Int. Cl.
*H01Q 21/26* (2006.01)
*H01Q 21/00* (2006.01)
*H01Q 21/12* (2006.01)

(52) U.S. Cl. ..... 343/798; 343/810; 343/812; 343/813; 343/814; 343/797

(58) Field of Classification Search ..... 343/810, 343/812–815, 795, 797, 798, 844, 776, 818, 343/819

See application file for complete search history.

(56) References Cited

U.S. PATENT DOCUMENTS

| | | | | |
|---|---|---|---|---|
| 5,440,318 | A | 8/1995 | Butland et al. | |
| 5,835,062 | A | 11/1998 | Heckaman et al. | |
| 6,034,649 | A * | 3/2000 | Wilson et al. | 343/795 |
| 6,072,439 | A * | 6/2000 | Ippolito et al. | 343/797 |
| 6,351,247 | B1 * | 2/2002 | Linstrom et al. | 343/797 |
| 6,456,241 | B1 | 9/2002 | Rothe et al. | |
| 6,480,167 | B2 * | 11/2002 | Matthews | 343/795 |
| 6,924,776 | B2 * | 8/2005 | Le et al. | 343/792.5 |
| 7,061,441 | B2 | 6/2006 | Schadler | |
| 7,173,572 | B2 * | 2/2007 | Teillet et al. | 343/810 |
| 2010/0013729 | A1 * | 1/2010 | Harel et al. | 343/837 |

* cited by examiner

*Primary Examiner* — Douglas W Owens
*Assistant Examiner* — Jennifer F Hu
(74) *Attorney, Agent, or Firm* — Baker & Hostetler LLP

(57) ABSTRACT

A phased-array antenna panel for a super economical broadcast system is provided. The phased-array antenna panel system includes an antenna panel support member, a first pair of striplines and a second pair of striplines. The antenna panel support member includes a front reflector surface to support first and second columns of constantly-spaced, crossed-dipole radiators, a first pair of signal ground cavities disposed beneath the first column of crossed-dipole radiators, a second pair of signal ground cavities disposed beneath the second column of crossed-dipole radiators, and a rear surface including first and second pairs of signal distribution cable connectors. The first pair of striplines are respectively disposed within the first pair of signal ground cavities and are coupled to the first pair of signal distribution connectors and the first column of crossed-dipole radiators. The second pair of striplines are respectively disposed within the second pair of signal ground cavities and are coupled to the second pair of signal distribution connectors and the second column of crossed-dipole radiators.

18 Claims, 9 Drawing Sheets

PHASED-ARRAY ANTENNA PANEL FOR A SUPER ECONOMICAL BROADCAST SYSTEM

CROSS-REFERENCE TO RELATED APPLICATIONS

This application claims priority to U.S. Provisional Patent Application Ser. No. 61/047,772 (entitled "Phased-Array Antenna Panel For a Super Economical Broadcast System," filed on Apr. 25, 2008), the contents of which is incorporated herein by reference in its entirety.

FIELD OF THE INVENTION

The present invention relates, generally, to cellular communication systems. More particularly, the present invention relates to a phased-array antenna panel.

BACKGROUND OF THE INVENTION

Cellular radiotelephone system base transceiver stations (BTSs), at least for some United States (U.S.) and European Union (EU) applications, may be constrained to a maximum allowable effective isotropically radiated power (EIRP) of 1640 watts. EIRP, as a measure of system performance, is a function at least of transmitter power and antenna gain. As a consequence of restrictions on cellular BTS EIRP, U.S., EU, and other cellular system designers employ large numbers of BTSs in order to provide adequate quality of service to their customers. Further limitations on cells include the number of customers to be served within a cell, which can make cell size a function of population density.

One known antenna installation has an antenna gain of 17.5 dBi, a feeder line loss of 3 dB (1.25" line, 200 ft mast) and a BTS noise factor of 3.5 dB, such that the Ga−NFsys=17.5−3.5−3.0=11 dBi (in uplink). Downlink transmitter power is typically 50 W. With feeder lines, duplex filter and jumper cables totaling −3.5 dB, the Pa input power to antenna is typically 16 W, such that the EIRP is 16 W+17.5 dB=1,000 W.

In many implementations, each BTS is disposed near the center of a cell, variously referred to in the art by terms such as macrocell, in view of the use of still smaller cells (microcells, nanocells, picocells, etc.) for specialized purposes such as in-building or in-aircraft services. Typical cells, such as those for city population density, have radii of less than 3 miles (5 kilometers). In addition to EIRP constraints, BTS antenna tower height is typically governed by various local or regional zoning restrictions. Consequently, cellular communication providers in many parts of the world implement very similar systems.

Restrictions on cellular BTS EIRP and antenna tower height vary within each countries. Not only is the global demand for mobile cellular communications growing at a fast pace, but there are literally billions of people, in technologically-developing countries such as India, China, etc., that currently do not have access to cellular services despite their willingness and ability to pay for good and inexpensive service. In some countries, government subsidies are currently facilitating buildout, but minimization of the cost and time for such subsidized buildout is nonetheless desirable. In these situations, the problem that has yet to be solved by conventional cellular network operators is how to decrease capital costs associated with cellular infrastructure deployment, while at the same time lowering operational expenses, particularly for regions with low income levels and/or low population densities. An innovative solution which significantly reduces the number of conventional BTS site-equivalents, while reducing operating expenses, is needed.

SUMMARY OF THE INVENTION

Embodiments of the present invention provide a phased-array antenna panel for a super economical broadcast system.

In one embodiment, a phased-array antenna panel system includes an antenna panel support member, a first pair of striplines and a second pair of striplines. The antenna panel support member includes a front reflector surface to support first and second columns of constantly-spaced, crossed-dipole radiators, a first pair of signal ground cavities disposed beneath the first column of crossed-dipole radiators, a second pair of signal ground cavities disposed beneath the second column of crossed-dipole radiators, and a rear surface including first and second pairs of signal distribution cable connectors. The first pair of striplines are respectively disposed within the first pair of signal ground cavities and are coupled to the first pair of signal distribution connectors and the first column of crossed-dipole radiators. The second pair of striplines are respectively disposed within the second pair of signal ground cavities and are coupled to the second pair of signal distribution connectors and the second column of crossed-dipole radiators.

In another embodiment, a phased-array antenna panel includes a front reflector surface, first and second pairs of signal cavities and a rear surface. The front reflector surface includes a pair of raised sections to respectively support first and second staggered columns of constantly-spaced, crossed dipole radiators. The first pair of signal ground cavities is disposed beneath the first column of crossed dipole radiators, while the second pair of signal ground cavities is disposed beneath the second column of crossed dipole radiators. The rear surface includes a first pair of signal distribution cable connectors disposed beneath the first pair of signal ground cavities, and a second pair of signal distribution cable connectors disposed beneath the second pair of signal ground cavities.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Embodiments of the present invention provide a phased-array antenna panel for a super economical broadcast system.

According to one aspect of the present invention, cell spacing, i.e., the distance between adjacent BTSs, is advantageously increased relative to conventional cellular systems while providing a consistent quality of service (QoS) within each cell. Preferred embodiments of the present invention increase the range of each BTS. Conventional macrocells typically range from about ¼ mile (400 meters) to a theoretical maximum of 22 miles (35 kilometers) in radius (the limit under the GSM standard); in practice, radii on the order of 3 to 6 ml (5-10 km) are employed except in high-density urban areas and very open rural areas. The present invention provides full functionality at the GSM limit of 22 ml, for typical embodiments of the invention, and extends well beyond this in some embodiments. Cell size remains limited by user capacity, which can itself be significantly increased over that of conventional macrocells in some embodiments of the present invention.

Commensurate with the increase in cell size, the BTS antenna tower height is increased, retaining required line-of-sight (for the customary 4/3 diameter earth model) propagation paths for the enlarged cell. Preferred embodiments of the present invention increase the height of the BTS antenna tower from about 200 feet (60 meters) anywhere up to about 1,500 ft (about 500 m). In order for the transmit power and receive sensitivity of a conventional cellular transceiver (user's hand-held mobile phone, data terminal, computer adapter, etc.) to remain largely unchanged, both the EIRP and receive sensitivity of the tower-top apparatus for the SEC system are increased at long distances relative to conventional cellular systems and reduced near the mast. These effects are achieved by the phased-array antenna and associated passive components, as well as active electronics included in the present invention.

Standard BTS equipment, such as transceivers, electric power supplies, data transmission systems, temperature control and monitoring systems, etc., may be advantageously used within the SEC system. Generally, from one to three or more cellular operators (service providers) may be supported simultaneously at each BTS, featuring, for example, 36 to 96 transceivers and 216 to 576 Erlang of capacity. Alternatively, more economical BTS transmitters (e.g., 0.1 W transmitter power) may be used by the cellular operators, further reducing cost and energy consumption. These economical BTSs have lower energy consumption than previous designs, due in part to performance of transmitted signal amplification and received signal processing at the top of the phased-array antenna tower rather than on the ground.

Figure 1:
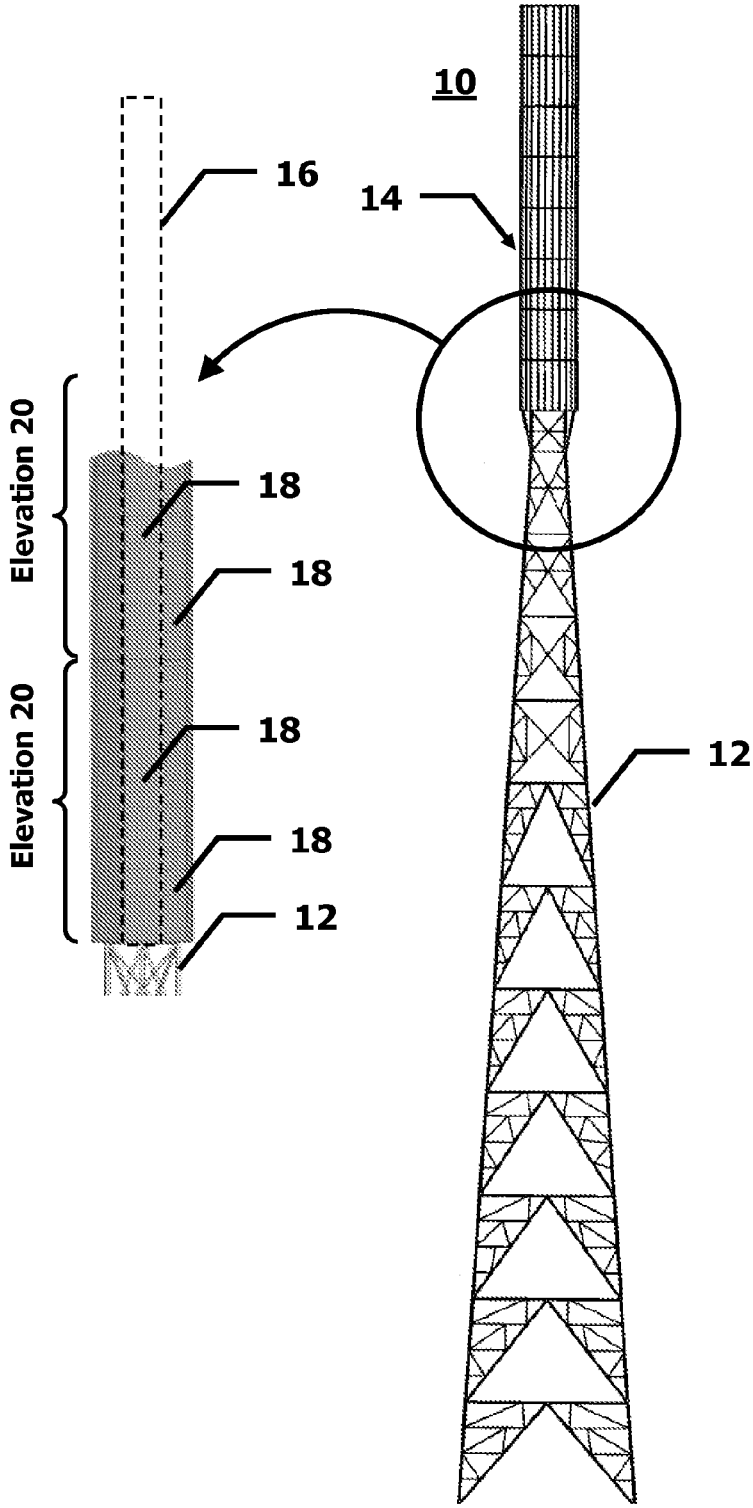
FIG. 1 depicts a perspective view of a base transceiver station antenna, in accordance with an embodiment of the present invention.

FIG. 1 presents a perspective view of a BTS antenna, in accordance with an embodiment of the present invention.

The base transceiver station 10 includes an antenna tower 12 and a phased-array antenna 14, with the latter disposed on an upper portion of the tower 12, shown here as the tower top. The antenna 14 in the embodiment shown is generally cylindrical in shape, which serves to reduce windload, and has a number of sectors 16, such as, for example, 6 sectors, 8 sectors, 12 sectors, 18 sectors, 24 sectors, 30 sectors, 36 sectors, etc., that collectively provide omnidirectional coverage for a cell associated with the BTS. Each sector 16 includes a number of antenna panels 18 in a vertical stack. Each elevation 20 includes a number of antenna panels 18 that can surround a support system to provide 360° coverage at a particular height, with each panel 18 potentially belonging to a different sector 16. Each antenna panel 18 includes a plurality of vertically-arrayed radiators, which are enclosed within radomes that coincide in extent with the panels 18 in the embodiment shown.

Feed lines, such as coaxial cable, fiber optic cable, etc., connect cellular operator equipment to the antenna feed system located behind the respective sectors 16. At the input to the feed system for each sector 16 are diplexers, power transmission amplifiers, low-noise receive amplifiers, etc., to amplify and shape the signals transmitted from, and received by, the phased-array antenna 14. In one embodiment, the feed system includes rigid power dividers to interconnect the antenna panels 18 within each sector 16, and to provide vertical lobe shaping and beam tilt to the panels 18 in that sector. In another embodiment, flexible coaxial cables may be used within the feed system.

Figure 2A:
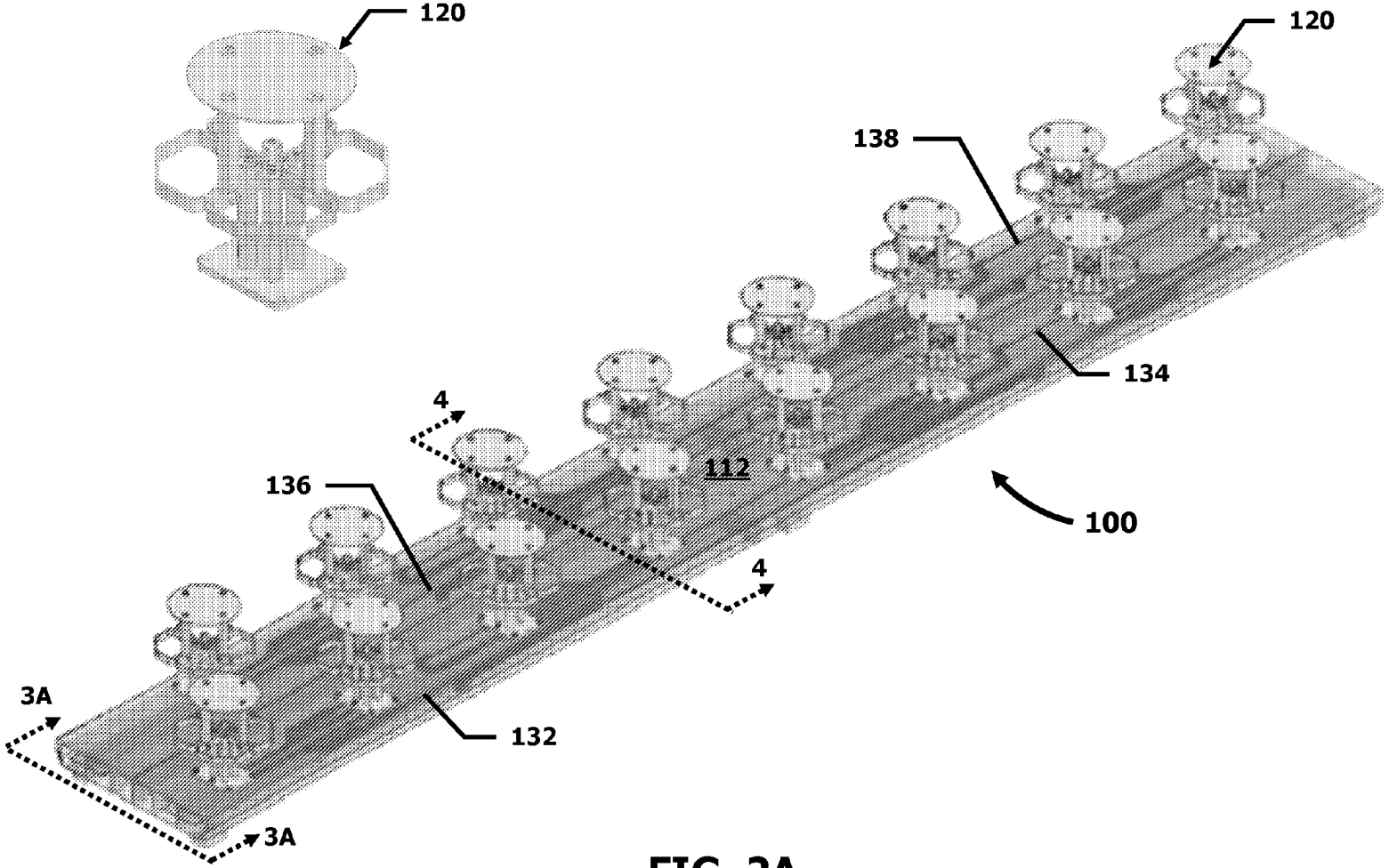
FIG. 2A depicts a perspective, semi-transparent view of a phased-array antenna panel, according to an embodiment of the present invention.
Figure 3A:
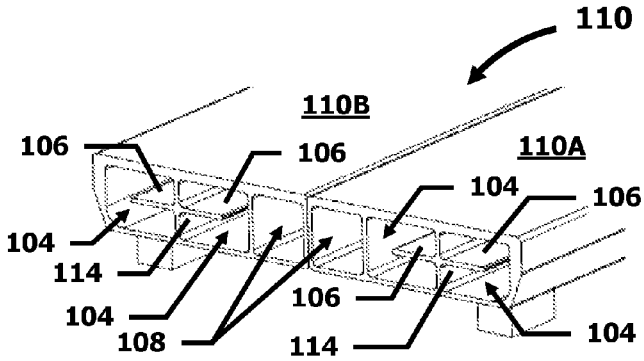
FIGS. 3A, 3B, and 3C each depict a perspective view of an end portion of a phased-array antenna panel, according to respective embodiments of the present invention.

FIGS. 2A and 3A depict a perspective, semi-transparent view of a phased-array antenna panel 100, according to an embodiment of the present invention. In a preferred embodiment, support member 110 advantageously provides a continuous reflector face 112 (or backplane) for a number of crossed dipole radiators 120, which are arranged in parallel columns on the support member 110 (See, also, FIG. 4). A number of striplines are provided within support member 110 to connect the crossed dipole radiators 120 to signal distribution cables and couplings disposed behind the support members 110 of phased-array antenna 14, shown in FIG. 1. In the depicted embodiment, two columns, each including eight crossed dipole radiators 120, are provided on each panel 100, and four striplines 132, 134, 136, 138, arranged in complementary pairs, connect the crossed dipole radiators 120 to the signal distribution cables. Each crossed dipole radiator includes two conductors, one for each dipole radiator.

In a preferred embodiment, the radiators 120 are transverse, quadrilateral, crossed-dipole radiators. A perspective view of an exemplary transverse, quadrilateral, crossed-dipole radiator 120 is also provided in FIG. 2A, whereof salient characteristics are described, in more detail, in one or more related copending patent applications. Transverse quadrilateral crossed dipole radiators 120 can be configured to exhibit low cross coupling, and, when suitably positioned and oriented, and fed with suitably phased signals, to exhibit low mutual coupling.

In the embodiment in FIG. 2A, eight equally-spaced dipole radiators 120 are provided in each of two staggered columns. The effective vertical spacing of successive radiators 120, alternating between the columns, is preferably offset by half, providing roughly half-wave spacing between radiator 120 centers in the embodiment shown. As addressed in a related copending application, the effective transmit and receive characteristics of the antenna are affected both by radiator-to-radiator spacing and by feed line phasing. A line through the centers of proximal radiators 120 in alternating columns forms a 45 degree angle with respect to a centerline of support member 110. Other numbers of equally-spaced dipole radiators 120 in each column, such as two, four, six, twelve, sixteen, etc., are also contemplated by the present invention.

In a preferred 900 MHz band embodiment, the radiators 120 within each column are separated, along the length of the antenna panel 100, by approximately 12 inches (e.g., 12.033 inches), and are offset with respect to the radiators within the adjacent column, along the length of the antenna panel 100, by approximately 6 inches (e.g., 6.017 inches). In this embodiment, the columns are separated by approximately 7½ inches (7.680 inches). In a preferred 1800 MHz band embodiment, the dimensions are all reduced by a factor of 0.5; other embodiments may be similarly accommodated. It is noted that the signals actually radiated and received by the inventive system are greater than, less than or equal to these center frequencies. For example, one 900 MHz band embodiment may include a range of frequencies for base station reception, e.g., 890-915 MHz, and a range of frequencies for base station transmission, e.g., 935-960 MHz.

In one embodiment, support member 110 is extruded from a high-strength material, such as an alloy of aluminum, and several cavities, extending longitudinally, are formed therein. Other fabrication methods and materials may be used to form support member 110, such as, for example, cold rolling, welding, etc. In the embodiment shown, support member 110 includes four (4) signal ground cavities 104, in which respective striplines 132, 134, 136, 138 are disposed. Support member 110 may also include one or more structural cavities 108, in order to provide additional lateral dimension, strength, etc.

Figure 4:
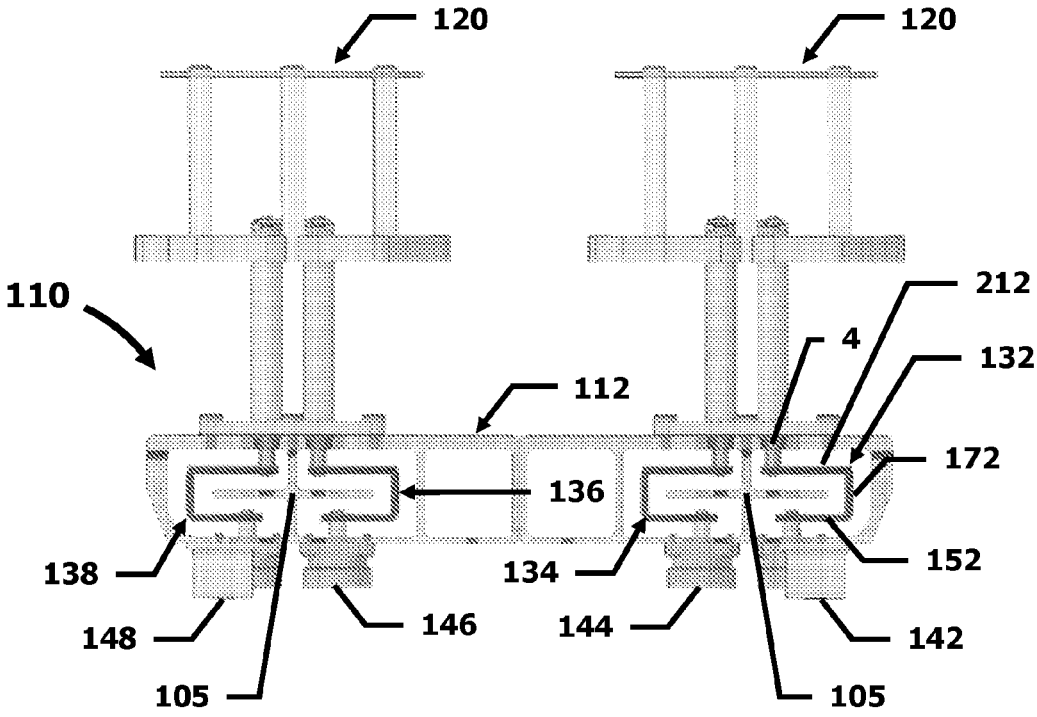
FIG. 4 depicts a sectional view of the phased-array antenna panel depicted in FIG. 2, according to an embodiment of the present invention.

FIG. 4 depicts a sectional view of the phased-array antenna panel depicted in FIGS. 2A and 3A, according to an embodiment of the present invention. In a preferred embodiment, each signal ground cavity 104 includes a transverse cross-member 106 that extends along the entire length of the signal ground cavity 104 in the longitudinal direction. Crossmember 106 extends partway out from a center web 114 along the width of the signal ground cavity 104 parallel to the reflector face 112, and thus cantilevered from the center web 114, thereby establishing C-shaped profiles for the signal ground cavities 104 into wherein striplines 132, 134, 136, 138 are disposed. Because the crossmembers 106 define in part the shapes of respective cavities 104, crossmember 106 width is preferably determined by such considerations as impedance uniformity and signal propagation characteristics of the striplines 132, 134, 136, 138.

When viewed from an end-on perspective, respective cross-members 106 of adjacent signal ground cavities 104, form a "cross-shaped" or "T-shaped" portion 105. Cross-members 106, as well as the interior surfaces of signal ground cavities 104, provide ground planes for respective striplines 130. In addition, cross-members 106 generally increase the stiffness of support member 110. Accordingly, extruded support member 110, with signal ground cavities 104 including cross-members 106, advantageously combines the functions of a low-loss feed system housing, a dipole radiator reflector, and a structural backbone in a unitized piece.

In another embodiment, support member 110 may be formed as two support member portions 110A and 110B, each of which includes two (2) signal ground cavities 104, with respective transverse members 106, and one or more optional structural cavities 108. The two portions may be formed by extrusion, and then subsequently joined by a number of methods, such as, for example, welding. The two support member portions 110A, 110B may be mirror-images of one another, identical, etc. In alternative embodiments, separate support member portions may be joined together using conductive elements, which establishes the backplane for the dipole radiators while maintaining the desired radiator separation. Alternatively, wedge-shaped joining members may be used to provide a relative angle between the respective backplanes of adjacent support member portions.

Figure 2B:
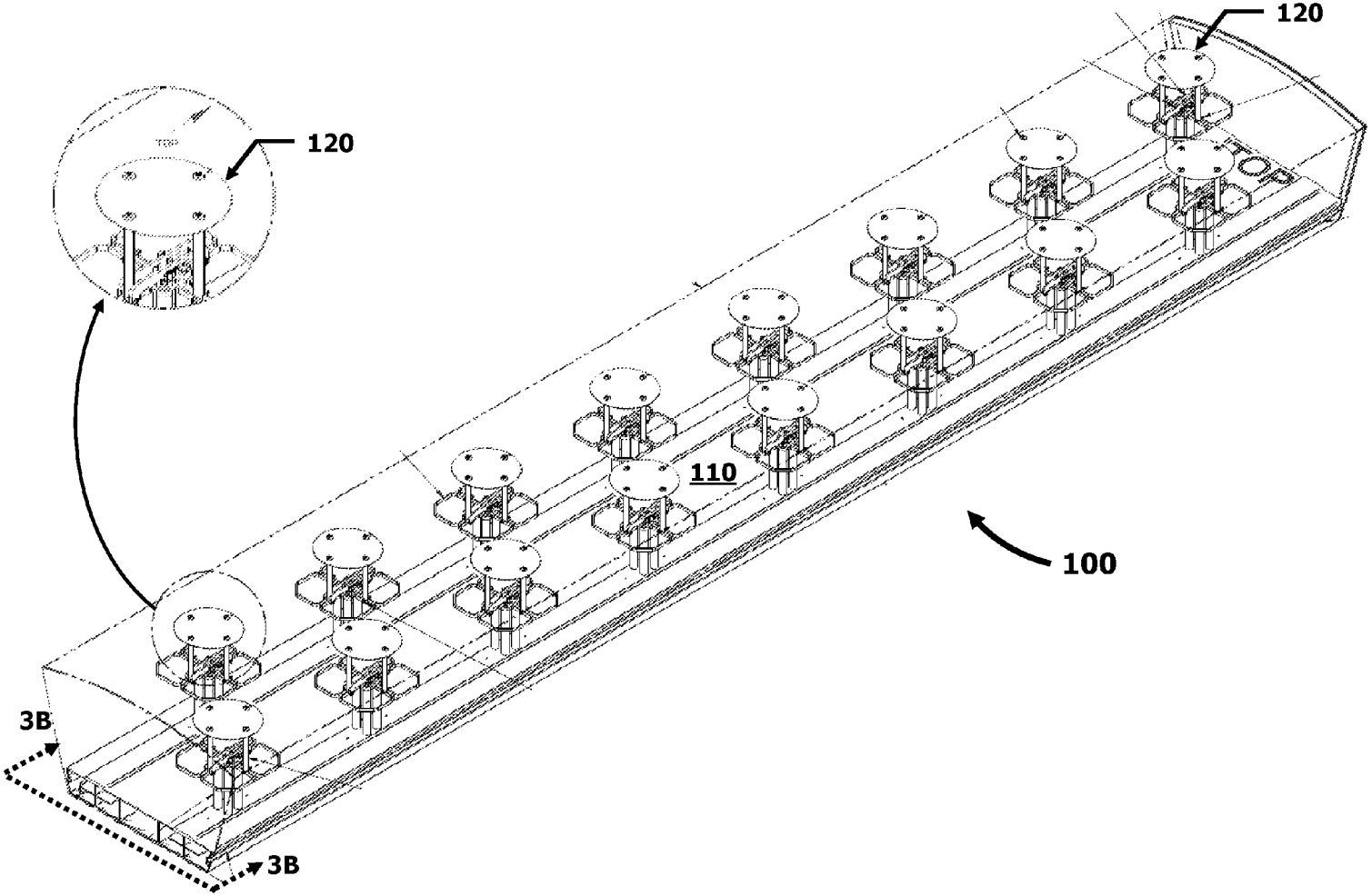
FIGS. 2B and 2C each depict a perspective view of a phased-array antenna panel, according to respective embodiments of the present invention.
Figure 3B:
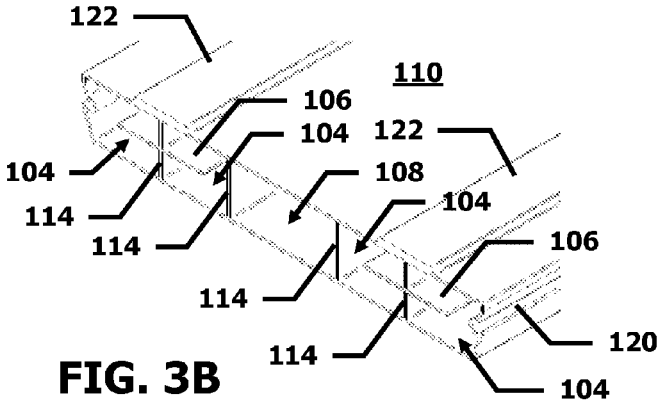

Another embodiment of antenna panel 100 is depicted in FIGS. 2B and 3B. In this embodiment, raised sections 122 are formed on support member 110 to provide additional support for dipole radiators 120. The frequency range supported by this embodiment may be, for example, the 900 MHz band.

In this embodiment, array panel 100 has an overall length of approximately 100 inches (e.g., 98.00 inches), an overall width of 12 inches (e.g., 12.60 inches) and an overall height of 2 inches (e.g., 1.91 inches). Generally, the array panel 100 has a thickness of approximately 0.1 inches (e.g., 0.08 inches), including the perimeter of the panel as well as the center webs 114 and cross members 106. The raised sections 122 are elevated above the support member 110 by approximately 0.2 inches (e.g., 0.17 inches) and offset by approximately 4 inches (e.g., 3.84 inches) from the centerline of the support member 110. Two outer center webs 114 are respectively disposed under the centerline of each raised section 122, while two inboard center webs 114 are respectively disposed between the centerline of the array panel 100 and the centerlines of the raised sections 122. Four, generally-rectangular signal ground cavities 104 are thereby formed, each enclosing approximately the same volume. For example, the two inner signal ground cavities may be approximately 2 inches in width, and 1½ inches in height (e.g., 2.06 inches by 1.58 inches), while the two outer signal ground cavities 104 may be approximately 2¼ inches in width and 1½ inches in height (e.g., 2.29 inches by 1.58 inches).

As shown in FIG. 3B, a circular groove 120 is formed in each side of support member 110 to receive a mating circular flange from a radome installed over the panel (shown as a dashed line in FIG. 2B). The radome may be constructed from an RF-transparent material suitable for a radome, such as, for example, polycarbonate. In this embodiment, groove 120 may have a radius of approximately ¼ inches (e.g., 0.22 inches). The radome includes two end caps and a center portion, the outer surface having a curved shape and a maximum height above the support member 110 of approximately 8 inches (e.g., 7.75 inches). Countersunk holes (not shown), of approximately ½ inch diameter, are provided in the raised sections 122 to accommodate the installation of each radiator 120. As depicted in FIG. 4, the two inner conductors of each radiator 120 pass through the holes in the raised section 122 and connect to a respective stripline disposed within the ground signal cavity 104 below.

Figure 2C:
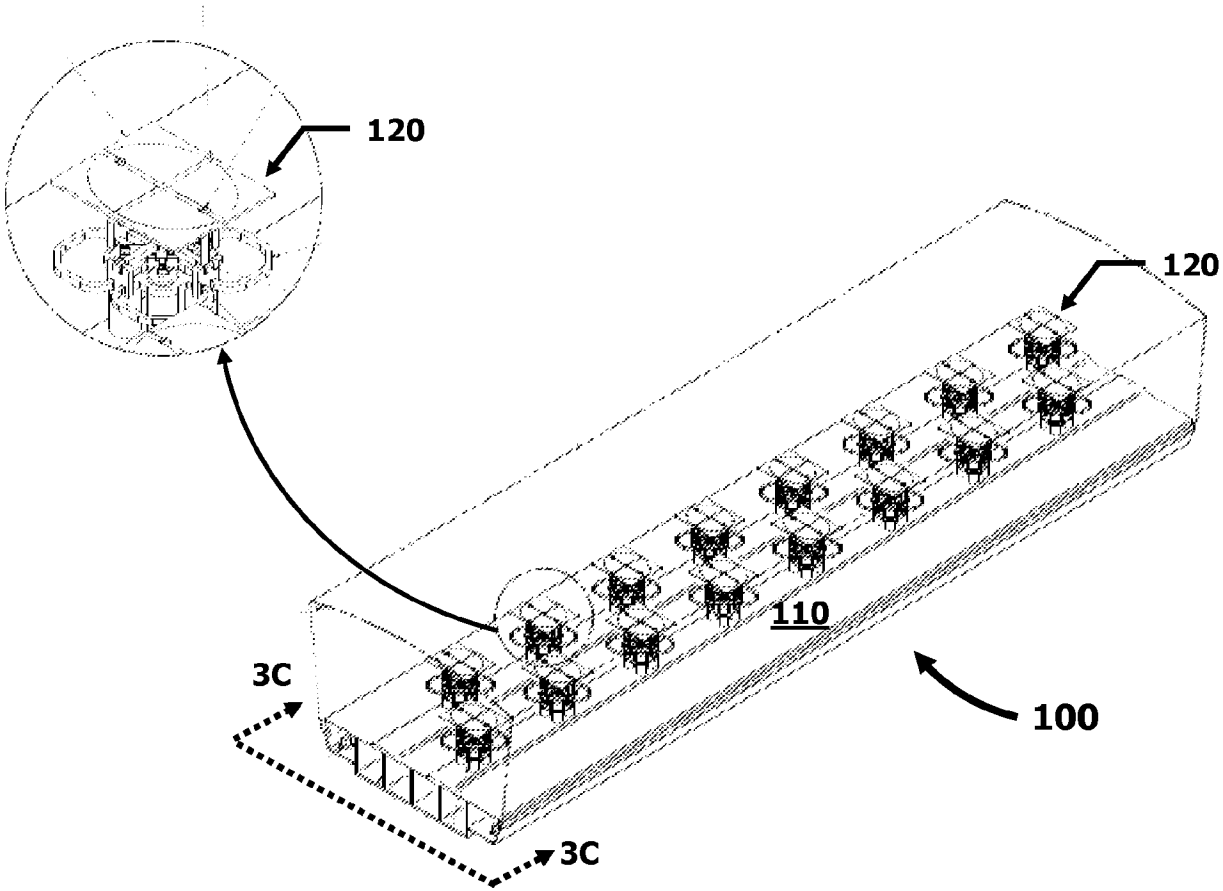
Figure 3C:
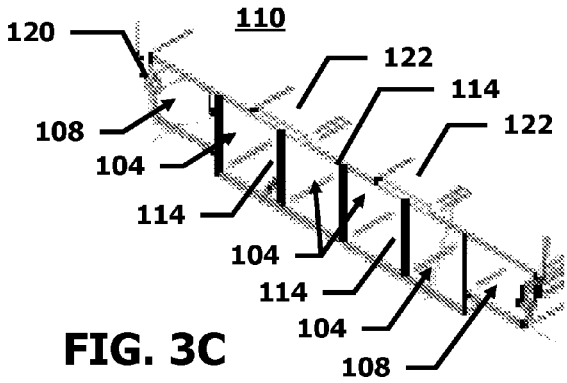

Another embodiment of antenna panel 100 is depicted in FIGS. 2C and 3C. In this embodiment, raised sections 122 are formed on support member 110 to provide additional support for dipole radiators 120. The frequency range supported by this embodiment may be, for example, the 1800 MHz band. In this embodiment, array panel 100 has an overall length of approximately 50 inches, an overall width of 12 inches and an overall height of 2 inches. Generally, the array panel 100 has a thickness of approximately 0.1 inches, including the perimeter of the panel as well as the center webs 114; no cross members are used in this embodiment. As shown in FIG. 3C, a circular groove 120 is formed in each side of support member 110 to receive a mating circular flange from a radome installed over the panel (shown as a dashed line in FIG. 2C). The radome may be constructed from an RF-transparent material suitable for a radome, such as, for example, polycarbonate. In this embodiment, groove 120 may have a radius of approximately ¼ inches. The radome includes two end caps and a center portion, the outer surface having a curved shape.

Figure 5A:
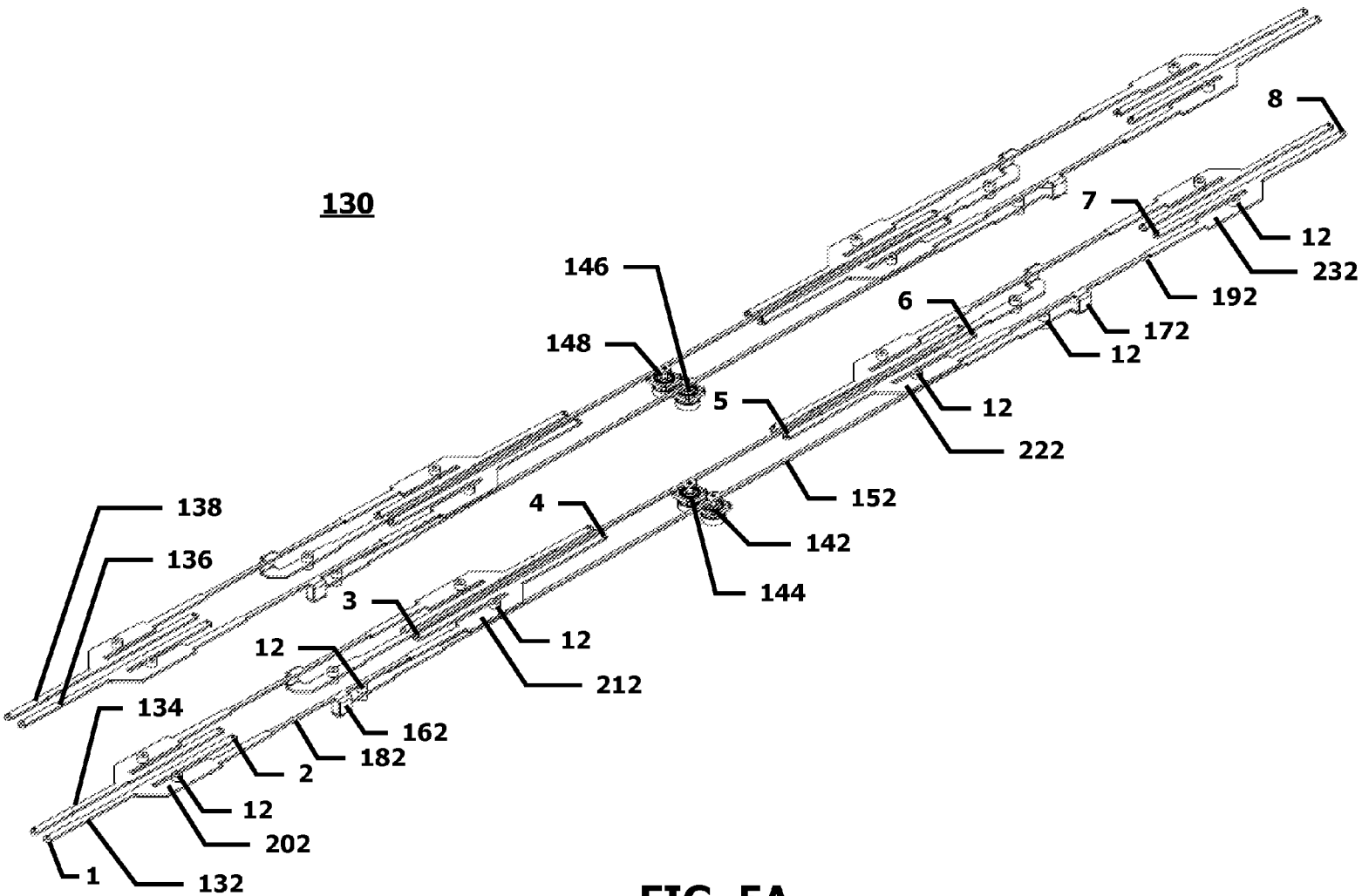
FIG. 5A depicts a perspective view of a number of striplines for a phased-array antenna panel, in accordance with an embodiment of the present invention.

FIG. 5A depicts a perspective view of a number of striplines for a phased-array antenna panel, in accordance with an embodiment of the present invention. In this embodiment, four striplines 132, 134, 136, 138 are positioned within respective "C-shaped" signal ground cavities 104 of support member 110. Two striplines connect each dipole radiator 120 to signal distribution cables (not shown). In particular, striplines 132, 134 connect the dipole radiators 120 in one column to signal distribution cables via respective coaxial connectors 142, 144, while striplines 136, 138 connect the dipole radiators 120 in the other column to signal distribution cables via respective coaxial connectors 146, 148. Striplines 132, 134, 136, 138 are made from suitable conductive material, such as electroless or similar copper alloy, spring brass, phosphor bronze, beryllium copper, an aluminum alloy, etc. They may be plated or coated for corrosion resistance, enhanced surface conductivity, or the like, and may be heat treated. Striplines 132, 134, 136, 138 may be cut, such as from flat stock, and bent into final shape, or may be vapor- or electro-deposited, plated onto mandrels, or otherwise formed.

Generally, each stripline includes a lower horizontal segment with a centrally-located signal distribution point, which may be a coaxial cable connector, and further includes two vertical segments and two upper horizontal segments, wherein each of the upper horizontal segments terminates in four dipole radiator connection points. For clarity and convenience, the advantageous features of the striplines will be discussed with respect to stripline 132. Coaxial connector 142 is attached to the center of the lower horizontal segment 152, which extends longitudinally in either direction. The end portions of lower horizontal segment 152 transition to respective double-bend, vertical transition segments 162, 172, which transition and divide in tee form at respective central portions of upper horizontal segments 182, 192. The upper horizontal segments 182, 192 include feed arm segments 202, 212, 222, 232 at central tees, with each segment 202, 212, 222, 232 terminating in two dipole radiator connection points 1-8. The upper horizontal segments 182, 192 are coplanar with respect to the lower horizontal segment 152.

The path lengths from the signal distribution cable connector 142 to the dipole radiator connection points 1-8 are substantially equal in the embodiment shown. In other embodiments, the respective path lengths may differ, resulting in phase differences between signals arriving at the radiator connection points 1-8, and determining beam properties in part.

Impedance is controlled at each tee division in the stripline 132 by normalizing the width of stripline 132 prior to the tee, reducing the width of each segment leading out from the tee according to an algorithm similar to that used for coaxial line impedance computation, then renormalizing the width of each segment at a preferred distance from the tee. In the embodiment shown, each tee divides the signal substantially equally. In other embodiments, power splitting may be made unequal by providing different widths, and thus impedances, on the outputs of each tee, so that the proportion of power coupled to each is determined separately. Like the above-described phase adjustment, power adjustment can determine beam properties in part.

Stripline 132 generally conforms to the three-dimensional, "C-shaped" signal ground cavity 104. Nonconductive standoffs 12 are used to achieve substantially uniform spacing therefrom, which provides several advantages, such as, for example, impedance control, etc. The final dimensions of stripline 132, as well as the distance to the respective surfaces of signal ground cavity 104, are chosen to substantially match the impedance of the signal distribution cables and couplings to which stripline 132 is joined.

In one embodiment, standoffs 12 are made from a dielectric material such as, for example, a low-loss ceramic, polytetrafluoroethylene (PTFE), polyethylene (PE), or the like. Standoffs 12 are attached to each side of stripline 132 and abut the surfaces of signal ground cavity 104. In other embodiments, single-sided or double-sided standoffs 12 may be internally threaded and aligned with corresponding holes in the walls of signal ground cavity 104, and dielectric screws may be threaded into standoffs 12 to establish positioning. Alternatively, standoffs 12 may be tubular in shape and hollow in cross-section, and dielectric rods, extending through signal ground cavity 104, may be used to locate standoffs 12. In further embodiments, foamed dielectric material may surround the striplines and fill the respective signal ground cavities 104, in whole or in part, in place of, or in addition to, the use of one or more discrete standoffs 12.

It may be observed that individual standoffs 12 fill a small part of the volume of the chamber 104, so that any radiator-to-radiator phase shift due to alteration of signal propagation velocity within the signal ground cavity 104 associated with the higher dielectric coefficients ($\in$) characteristic of solid materials is kept low. Similarly, selective use of a foamed dielectric material, such as PTFE or PE, which may have around 30% density of solids, can also reduce the effect of the higher $\in$ of the solid material to a substantially negligible level.

Installation of striplines 132, 134, 136, 138 into respective signal ground cavities 104 may be complicated by the geometry of the signal ground cavities 104 as well as the particular dimensions and composition of the striplines. To facilitate installation, a carrier may be used to introduce each stripline into the respective signal ground cavity 104. In one embodiment, the carrier provides a rigid support, and may include a low-friction exterior. After location of the stripline within the signal ground cavity and attachment to standoffs 12, the carrier may be removed.

In one embodiment, striplines 132, 134, 136 and 138 are dimensioned to accommodate the 900 MHz band such that the dipole radiator connection points 1-8 are spaced appropriately, e.g., 12 inches. For example, in a preferred embodiment, the thickness of each stripline is approximately 0.125 inches. With respect to stripline 132, for example, the central portion of the lower horizontal segment 152 is approximately 0.2 inches in width (e.g., 0.178 inches) and expands, in a series of step-width sections, to approximately 0.6 inches (0.620 inches) at the transitions to the double-bend, vertical transition segments 162, 172. The vertical segments 162, 172 respectively transition to the central portion of the upper horizontal segments 182, 192, which are approximately 0.2 inches in width (e.g., 0.178 inches), which expands, in a series of step-width sections, to approximately 0.9 inches (e.g., 0.880 inches), before transitioning to respective feed arm segments 202, 212, 222, 232, each having a width of approximately 0.370 inches. The overall length of stripline 132 is approximately 84 inches (e.g., 84.601 inches), the height is approximately 1 inch (e.g., 0.954 inches), and the maximum width is approximately 1½ inches (e.g., 1.534 inches).

In a preferred embodiment, two pairs of step-width transitions are provided in the lower horizontal segment 152, each pair including a first transition section having a width of approximately ¼ inches (e.g., 0.237 inches) and a length of approximately 3.3 inches (e.g., 3.300 inches), and a second transition section having a width of approximately 0.4 inches (e.g., 0.390 inches) and a length of approximately 3.3 inches (e.g., 3.345 inches). Similarly, a single pair of step-width transitions is provided in each upper horizontal segments 182, 192, each pair including a width of approximately 0.4 inches (e.g., 0.395 inches) and a length of approximately 3.5 inches (e.g., 3.510 inches).

Figure 5B:
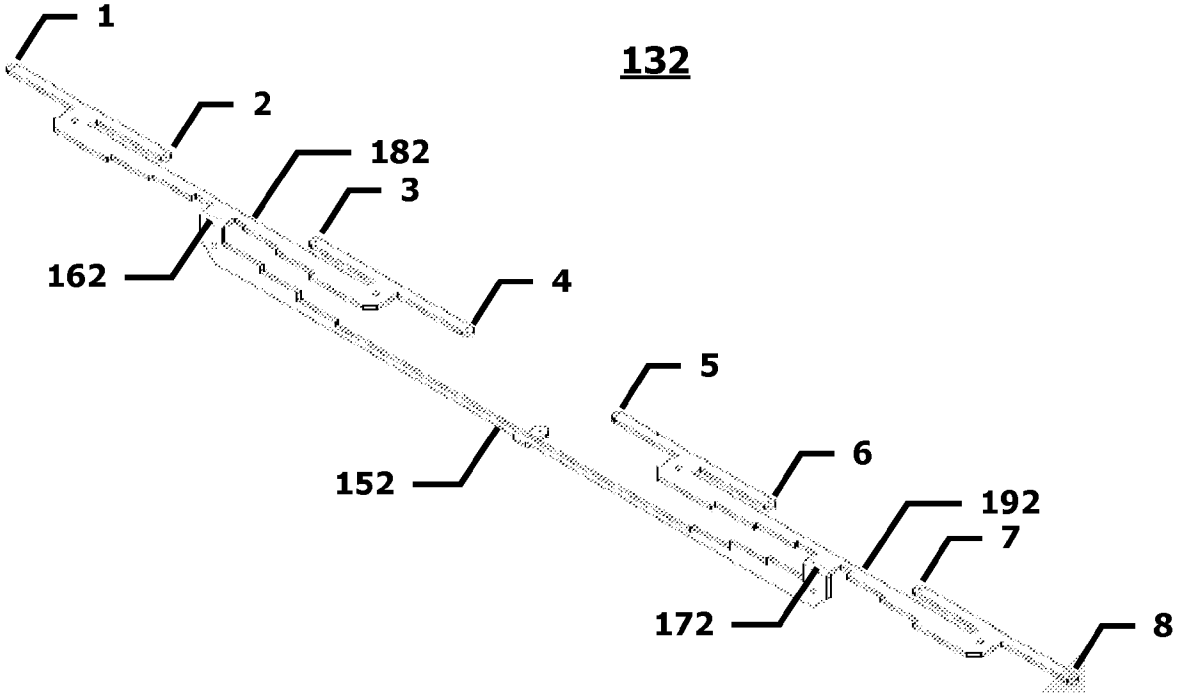
FIG. 5B depicts a perspective view of an exemplary stripline for a phased-array antenna panel, in accordance with another embodiment of the present invention.

FIG. 5B depicts a perspective view of an exemplary stripline for a phased-array antenna panel, in accordance with an embodiment of the present invention. In this embodiment, stripline 132 is dimensioned to accommodate the 1800 MHz band such that the dipole radiator connection points 1-8 are spaced appropriately, e.g., 6 inches. For example, in a preferred embodiment, the thickness of each stripline is approximately 0.125 inches, and the overall length of stripline 132 is approximately 42 inches (e.g., 42.370 inches). Advantageously, because the vertical transition segments 162, 172 have a single bend, the upper horizontal segments 182, 192 are disposed perpendicular to the lower horizontal segment 152, and cross members 106 are not required.

Figure 6:
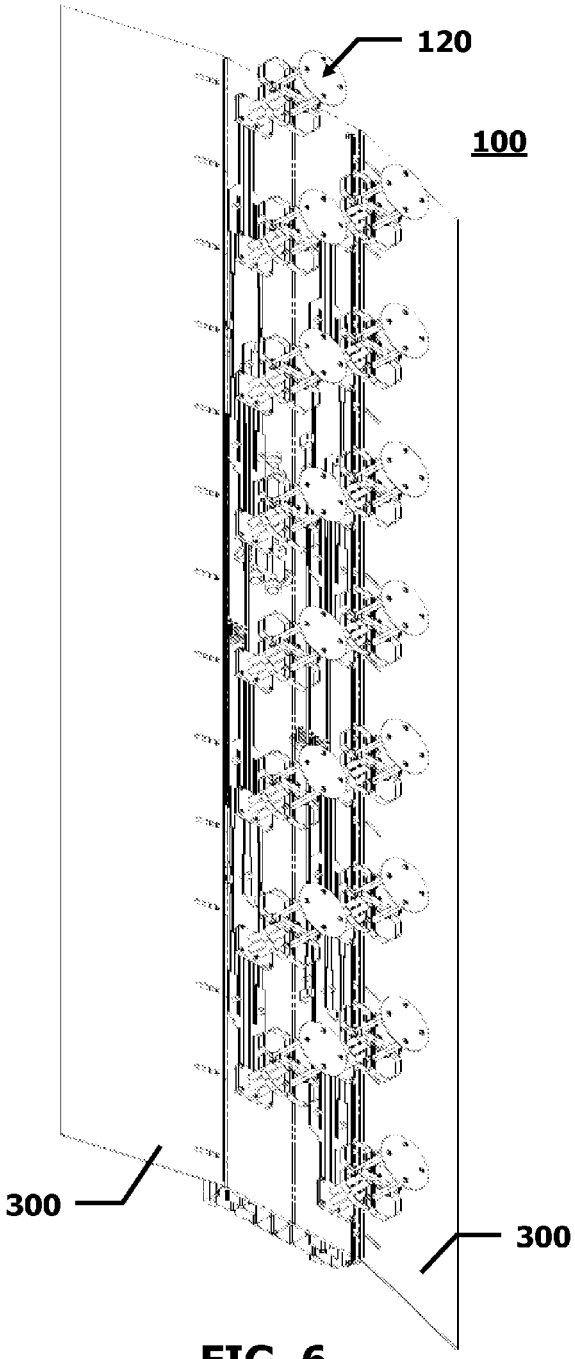
FIG. 6 depicts a perspective front view of a phased-array antenna panel, in accordance with an embodiment of the present invention.
Figure 7:
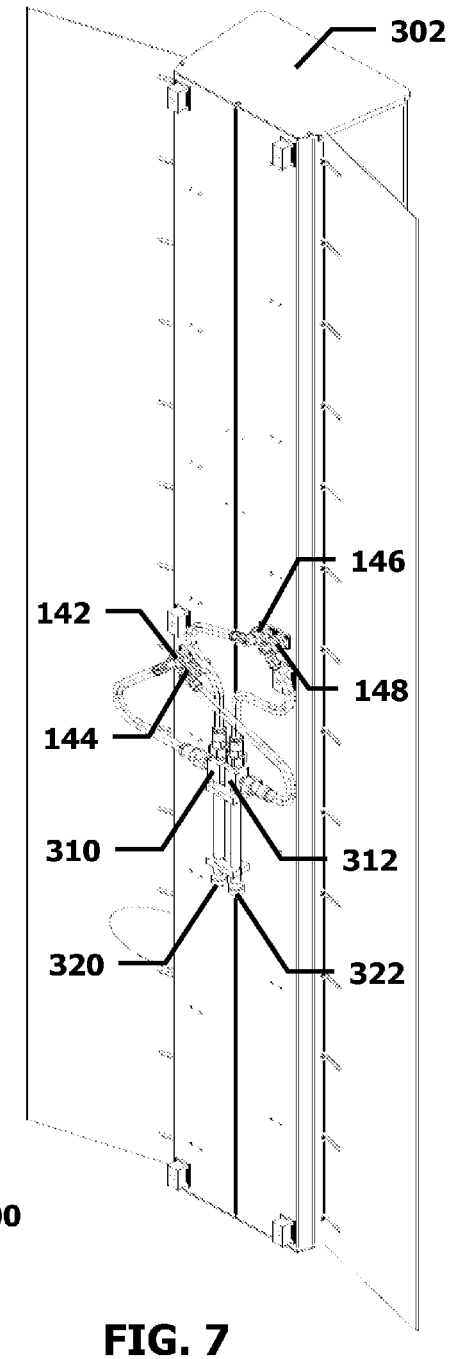
FIG. 7 depicts a perspective rear view of a phased-array antenna panel, in accordance with an embodiment of the present invention.

FIG. 6 depicts a perspective front view of a phased-array antenna panel, in accordance with an embodiment of the present invention, while FIG. 7 depicts a perspective rear view of a phased-array antenna panel, in accordance with an embodiment of the present invention.

Signal distribution cable connectors 142, 144, 146, 148 are coupled to signal splitters 310, 312, which divide the respective signals carried by signal feed lines 320, 322. In the embodiment depicted in FIG. 7, the signal(s) carried by signal feed line 320 are split by signal splitter 310, and then provided to signal distribution cable connectors 142, 146, while the signal(s) carried by signal feed line 322 are split, by signal splitter 312, and then provided to signal distribution cable connectors 144 and 148. In this embodiment, each dipole radiator is advantageously coupled to both signal feed lines 320, 322. In a preferred embodiment, signal splitters 310, 312 divide the respective signals carried by signal feed lines 320, 322 into orthogonal components.

Radome 302 is substantially transparent to the frequencies of interest, and encloses antenna panel 100 in order to protect dipole radiators 120 against the adverse effects of weather, etc. In one embodiment, a single sector 16 may be employed, and additional backplane surfaces 300 may be attached to each side of antenna panel 100.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A phased-array antenna panel system, comprising:

an antenna panel support member, including:

a front reflector surface to support first and second columns of constantly-spaced, crossed-dipole radiators, a first pair of signal ground cavities, extending longitudinally along the support member, disposed beneath the first column of crossed-dipole radiators, a second pair of signal ground cavities, extending longitudinally along the support member, disposed beneath the second column of crossed-dipole radiators, and a rear surface, including a first pair of signal distribution cable connectors disposed beneath the first pair of signal ground cavities, and a second pair of signal distribution cable connectors disposed beneath the second pair of signal ground cavities;

a first pair of striplines, respectively disposed within the first pair of signal ground cavities and coupled to the first pair of signal distribution connectors and the first column of crossed-dipole radiators; and a second pair of striplines, respectively disposed within the second pair of signal ground cavities and coupled to the second pair of signal distribution connectors and the second column of crossed-dipole radiators.

2. The system of claim 1, wherein each stripline includes a plurality of constantly-spaced, radiator connection points.

3. The system of claim 2, wherein each radiator connection point is coupled to a single crossed-dipole radiator.

4. The system of claim 3, wherein each radiator connection point is coupled to one dipole of the crossed-dipole radiator.

5. The system of claim 1, wherein each pair of striplines includes a plurality of constantly-spaced, radiator connection point pairs, each coupled to a single crossed-dipole radiator.

6. The system of claim 5, wherein the radiator connection point pairs from the first pair of striplines are arranged in a staggered relationship to respective radiator connection point pairs from the second pair of striplines.

7. The system of claim 6, wherein the radiator connection points pairs within each pair of striplines are constantly-spaced by approximately one operational wavelength, and the respective radiator connection point pairs between each pair of striplines are staggered by approximately one-half of an operational wavelength.

8. The system of claim 1, wherein each stripline includes a lower horizontal segment having a central portion coupled to a respective signal distribution connector, a pair of vertical transition segments coupled to respective ends of the lower horizontal segment, and a pair of upper horizontal segments, each having a central portion coupled to a respective vertical transition segment and a pair of feed arm segments, each having a radiator connection point disposed at an end thereof.

9. The system of claim 8, wherein the lower horizontal segment and the pair of upper horizontal segments are coplanar.

10. The system of claim 8, wherein the lower horizontal segment and the pair of upper horizontal segments are perpendicular.

11. The system of claim 1, wherein each signal ground cavity includes a cross member that longitudinally extends along the length of the cavity and transversely extends at least halfway into the cavity.

12. The system of claim 11, wherein each stripline conforms to the cross member with the signal ground cavity.

13. The system of claim 1, further comprising a pair of signal splitters, respectively coupled to the first and second pairs of signal distribution cable connectors, and a pair of signal feed lines, respectively coupled to the pair of signal splitters.

14. A phased-array antenna panel, including:

a front reflector surface including a pair of raised sections to respectively support first and second staggered columns of constantly-spaced, crossed-dipole radiators;

a first pair of signal ground cavities, extending longitudinally along the support member, disposed beneath the first column of crossed-dipole radiators;

a second pair of signal ground cavities, extending longitudinally along the support member, disposed beneath the second column of crossed-dipole radiators; and a rear surface, including a first pair of signal distribution cable connectors disposed beneath the first pair of signal ground cavities, and a second pair of signal distribution cable connectors disposed beneath the second pair of signal ground cavities.

15. The antenna panel of claim 14, wherein each signal ground cavity includes a central cross member that longitudinally extends along the length of the cavity and transversely extends at least halfway into the cavity.

16. The antenna panel of claim 14, further comprising a pair of grooves, disposed in respective side surfaces of the antenna panel, to receive a mating circular flange of a radome.

17. The antenna panel of claim 14, wherein the pair of raised sections are transversely offset from one another by at least one-half of an operational wavelength.

18. A phased-array antenna panel system, comprising:

a first column of constantly-spaced, transverse quadrilateral crossed-dipole radiators, each having a pair of inner dipole conductors;

a second column of constantly-spaced, transverse quadrilateral crossed-dipole radiators, each having a pair of inner dipole conductors, arranged in a staggered relationship with respect to the first column of crossed-dipole radiators;

an antenna panel support member, including:

a front reflector surface to support the first and second columns of crossed-dipole radiators, a first signal ground cavity, extending longitudinally along the antenna panel support member, disposed beneath at least a portion of the first column of crossed-dipole radiators, a second signal ground cavity, extending longitudinally along the antenna panel support member, disposed beneath at least a portion of the first column of crossed-dipole radiators, a third signal ground cavity, extending longitudinally along the antenna panel support member, disposed beneath at least a portion of the second column of crossed-dipole radiators, a fourth signal ground cavity, extending longitudinally along the antenna panel support member, disposed beneath at least a portion of the second column of crossed-dipole radiators, and a rear surface, including a first signal distribution cable connector disposed beneath the first signal ground cavity, a second signal distribution cable connector disposed beneath the second signal ground cavity, a third signal distribution cable connector disposed beneath the third signal ground cavity, and a fourth signal distribution cable connector disposed beneath the fourth signal ground cavity;

a first stripline, disposed within the first signal ground cavity and coupled to the first signal distribution connector and the first inner dipole conductors of the first column of crossed-dipole radiators;

a second stripline, disposed within the second signal ground cavity and coupled to the second signal distribution connector and the second inner dipole conductors of the first column of crossed-dipole radiators;

a third stripline, disposed within the third signal ground cavity and coupled to the third signal distribution connector and the first inner dipole conductors of the second column of crossed-dipole radiators; and a fourth stripline, disposed within the fourth signal ground cavity and coupled to the fourth signal distribution connector and the second inner dipole conductors of the second column of crossed-dipole radiators.

* * * * *